US005169082A

United States Patent [19]

da Silva et al.

[11] Patent Number: 5,169,082

[45] Date of Patent: Dec. 8, 1992

[54] METHOD AND APPARATUS FOR SPLICING REELS OF PAPER

[75] Inventors: Domingos da Silva, Cortaillod; Marc Budin, Marin, both of Switzerland

[73] Assignee: Fabriques de Tabac Reunies, S.A., Neuchatel, Switzerland

[21] Appl. No.: 743,121

[22] Filed: Aug. 9, 1991

[30] Foreign Application Priority Data

Aug. 24, 1990 [CH] Switzerland ..... 2750/90

[51] Int. Cl.[5] ..... B65H 19/18

[52] U.S. Cl. ..... 242/58.1; 242/58.2; 242/58.4; 242/58.6

[58] Field of Search ..... 242/58.1, 58.2, 58.3, 242/58.4, 58.5, 58.6

[56] References Cited

U.S. PATENT DOCUMENTS

| | | | |
|---|---|---|---|
| 2,945,462 | 7/1960 | Oberauer | 113/1 |
| 3,252,671 | 5/1966 | Phillips, Jr. et al. | 242/58.1 |
| 3,741,079 | 6/1973 | Bossons et al. | 242/58.1 X |
| 4,492,609 | 1/1985 | Blom | 242/58.5 X |
| 4,646,986 | 3/1987 | Heitmann | 242/58.1 |
| 4,674,697 | 6/1987 | Filter et al. | 242/58.1 |
| 4,694,714 | 9/1987 | Focke et al. | 242/58.4 X |
| 4,821,971 | 4/1989 | Watanabe et al. | 242/58.3 X |
| 4,821,972 | 4/1989 | Grollimund et al. | 242/56 R |
| 4,881,695 | 11/1989 | Beisswanger | 242/58.3 X |
| 4,995,406 | 2/1991 | da Silva | 131/105 |
| 5,018,535 | 5/1991 | da Silva et al. | 131/60 |
| 5,020,736 | 6/1991 | Thievessen | 242/58.5 X |

FOREIGN PATENT DOCUMENTS

| | | | |
|---|---|---|---|
| 2638976 | 2/1978 | Fed. Rep. of Germany . | |
| 2154217 | 9/1985 | United Kingdom | 242/58.1 |

*Primary Examiner*—Daniel P. Stodola
*Assistant Examiner*—John P. Darling
*Attorney, Agent, or Firm*—Jeffrey H. Ingerman

[57] ABSTRACT

A cylindrical seizing element (3), made up of a fixed tubular part (32) comprising a cylindrical sector-shaped aperture (30) having a series of teeth (34) and of a movable inside part (31) also having a series of teeth (36) interposed between the first series of teeth, seizes the ends of turns of paper previously severed on a fresh reel of paper and brings the strip of paper unwinding from this fresh reel opposite a strip unwinding from an expiring reel. A splicing device comprising two rollers which are pressed against one another, one on each side of the two strips of paper, creates a splice through perforation of the two strips in an arrangement ensuring the strength of the splice. The method and apparatus are designed especially for integration in a single piece of equipment and for reliably joining two strips of paper intended to encircle cigarette filters.

7 Claims, 5 Drawing Sheets

METHOD AND APPARATUS FOR SPLICING REELS OF PAPER

Figure 1:
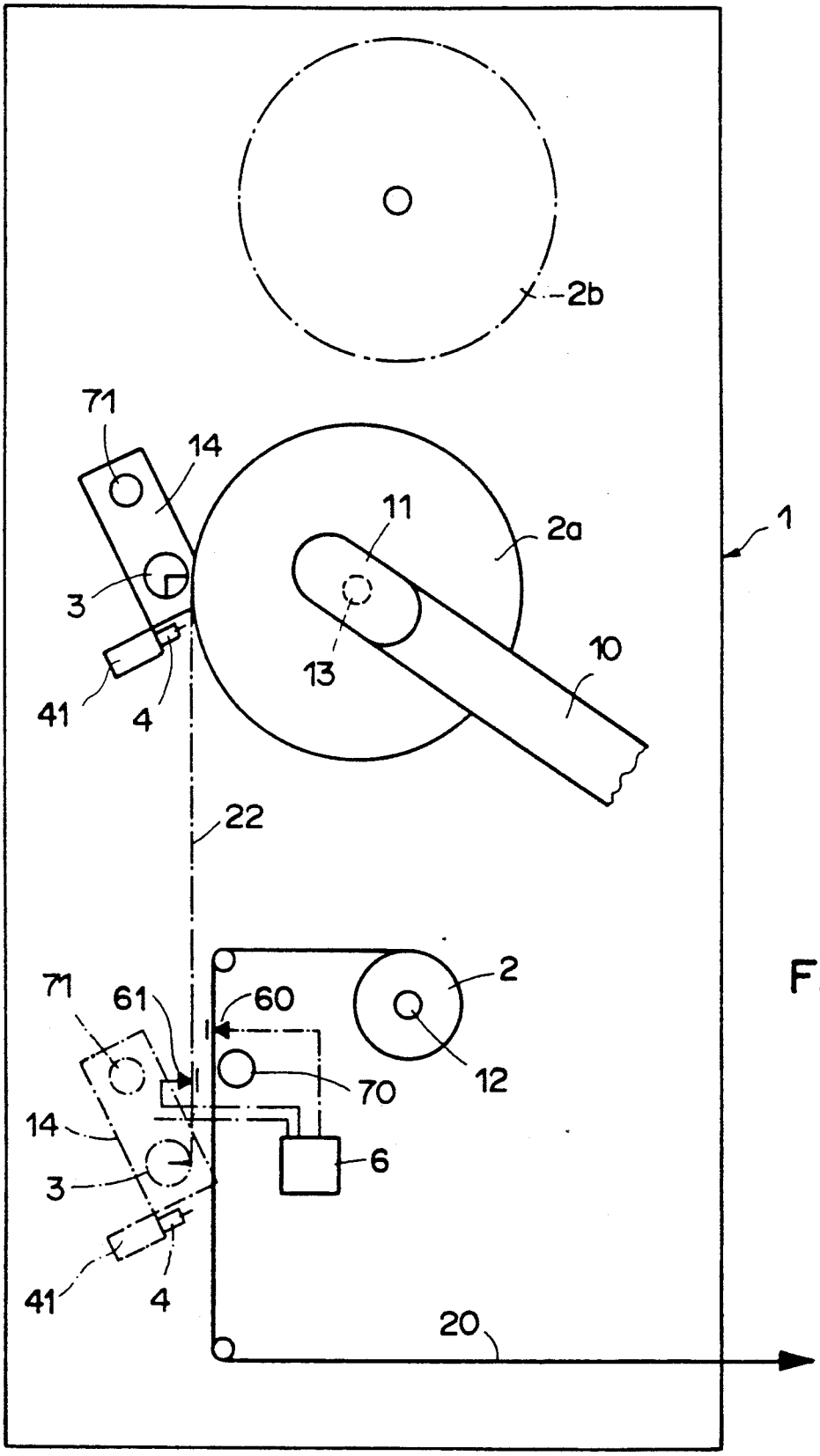

This invention relates to the handling of paper material, and more particularly to a method of opening a full reel consisting of a web of paper wound in successive turns, and of connecting the outside end of the web of paper of the full reel to an inside end of a web of paper of a virtually empty reel rotating on a first rotating shaft.

The invention further relates to apparatus for carrying out the foregoing method, of the type having a first rotating shaft supporting a reel of unwinding paper, a second rotating shaft, parallel to the first rotating shaft and supporting a full or unwinding reel, a first cutting device capable of effecting a cut of a certain number of outer turns of the full reel, along a line parallel to the second rotating shaft, and robotized arm means charged with placing a full reel on the second rotating shaft and withdrawing the virtually empty reel from the first rotating shaft.

Finally, the invention also relates to a cylindrical seizing element, a blower device, a pressing-roller device, and a splice of paper or aluminum strips produced with the aid of the pressing-roller device.

The cigarette industry uses webs of paper to form the cylinder of paper containing the tobacco. Such webs of paper are supplied in reels made up of a large number of turns successively wound up in order to constitute a very long strip of paper. The same applies to the paper intended to encircle the filter of the cigarettes, which paper is of another type than that directly surrounding the tobacco of the cigarette. Considering the high speed of production of modern machines, it is advantageous to find a method and apparatus for splicing the outside, or leading, end of a web of paper on a fresh reel to the inside, or trailing, end of a web of paper on a reel which will soon be empty, without interrupting the feed of paper to the machine situated downstream which is to place the web of paper around the rod of tobacco, or to place the web of paper around the filter.

Various methods and apparatus have been proposed for, splicing the leading end of a web of paper coming from a fresh reel to the trailing end of a web of paper coming from an expiring reel. In particular, U.S. Pat. No. 4,995,406 describes a method and apparatus for opening a reel made up of a web of paper, whereas U.S. Pat. No. 5,018,535 describes a method and a machine for joining webs of paper end to end. The latter reference, as well as other patents forming part of the prior art, apply to the joining by crimping of webs of paper intended to wrap the rod of tobacco for cigarettes. When two webs of paper intended to encircle the filters of cigarettes are to be connected, the prior art methods and apparatus are no longer suitable owing to the particular mechanical characteristics of this type of paper. As a matter of fact, the paper encircling the filter of a cigarette has a structure and texture different from those of cigarette paper, with glue as a bond, which increases its roughness and decreases its porosity; on the other hand, although the strip of paper wrapping the cigarette rod is then disposed longitudinally with respect to the rod—which means that the strip of paper is generally rather narrow, on the order of 25 mm—that is not true of the strip of paper intended to encircle the cigarette filter, where this strip is wound transversely with respect to the filter. Since the machine generally presents two filters disposed end to end, and since the filters may be relatively long, the filter-paper strips may be appreciably wider than the cigarette paper, viz., up to 70 mm. This, together with the aforementioned particular structure of the paper, prevents splicing by simple crimping according to the prior art from being used for such strips inasmuch as joining by crimping is not strong enough. In this case, splicing must take place by strong interpenetration of one strip of paper into the other, going as far as perforation of the strips.

Other previously used methods of splicing, usually by gluing one strip of paper to the other, do not permit high-speed operation.

It is therefore an object of this invention to provide an improved method and apparatus capable, first of all, of opening a fresh reel, then of splicing the leading end of the web of paper coming from this fresh reel to the trailing end of a virtually empty reel, this method and apparatus being applicable to strips of paper intended to encircle cigarette filters.

Another object of the invention is to provide apparatus in which the reel-opening device and the splicing device are combined in the same machine, thus reducing the bulk of this equipment.

A further object of the invention is to provide a method and apparatus which—considering the particular characteristics of the splicing of the two strips, viz., a splice especially resistant to the traction of one strip relative to the other—can be used for splicing other kinds of strips than just strips of paper, e.g., thin strips of aluminum.

Still another object of the invention is to provide a method and apparatus which present no hindrance to the splicing of strips of cigarette paper.

To this end, the opening and splicing method according to the present invention comprises the following steps:

1. actuating a first cutting device in order to cut a certain number of outer turns of the full reel along a line parallel to the axis of the second rotating shaft, 2. bringing a cylindrical seizing element, the axis of which is parallel to that of the first rotating shaft, into tangential contact through its outer cylindrical surface against the outer cylindrical surface of the full reel, a seizing aperture of the seizing element being opened in order to receive one end of the cut turns, then the aperture being closed in order to grip that end of the cut turns, the seizing element being set in rotation in order to wind up the groups of cut turns, as well as a few of the outer turns of the full reel, this setting the full reel in rotation, 3. traversing the rotating seizing element in order to bring it in proximity to the strip of paper of the virtually empty reel, in such a way that the strip of the full reel unwinds in proximity to, parallel to, and at the same speed as the strip of the virtually empty reel, 4. successively actuating: a second cutting device in order to cut the portion of paper strip attached to the virtually empty reel, then a pressing-roller device in order to fix the web of paper coming from the full reel to the web of paper coming from the virtually empty reel, then a third cutting device in order to cut the portion of paper strip attached-to the seizing device.

In the apparatus according to the present invention, of the type initially mentioned, the improvement comprises a cylindrical seizing element including a seizing portion; a blower device having inclined nozzles, cooperating with the seizing element and capable of separating the cut outer turns on the full reel and introducing them into the seizing element; robotized arm means capable of moving the seizing element to bring it in proximity to the strip of paper of the virtually empty reel and of withdrawing the unwinding reel from the second rotating shaft to place it on the first rotating shaft; a second cutting device capable of cutting the portion of strip attached to the virtually empty reel; a pressing-roller device capable of splicing the web of paper coming from the full reel to the web of paper coming from the virtually empty reel; a third cutting device capable of cutting the portion of strip attached to the seizing device upstream from the splice; means for withdrawing the turns of paper wound around the seizing device; and means for automatically guiding the process.

Figure 2A:
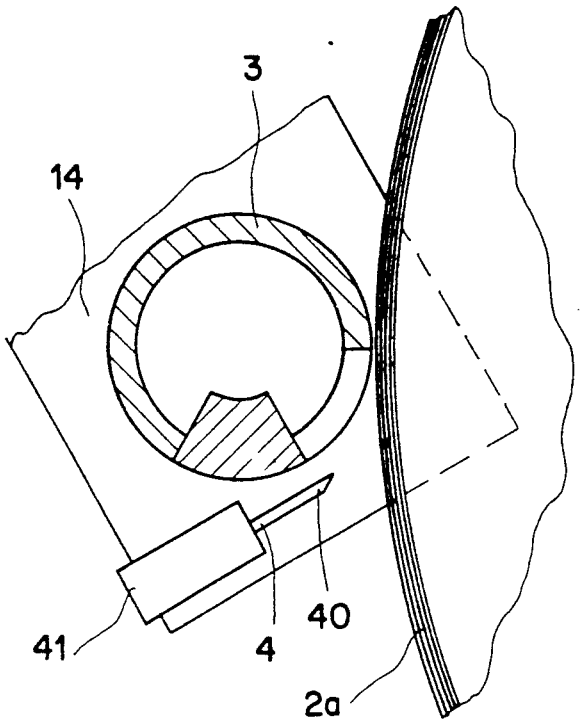
Figure 2B:
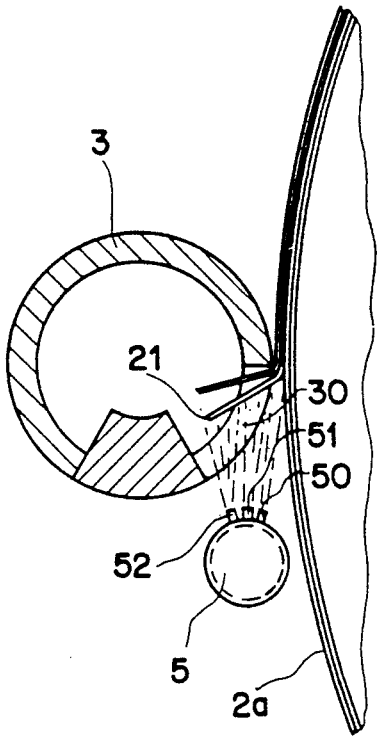
Figure 2C:
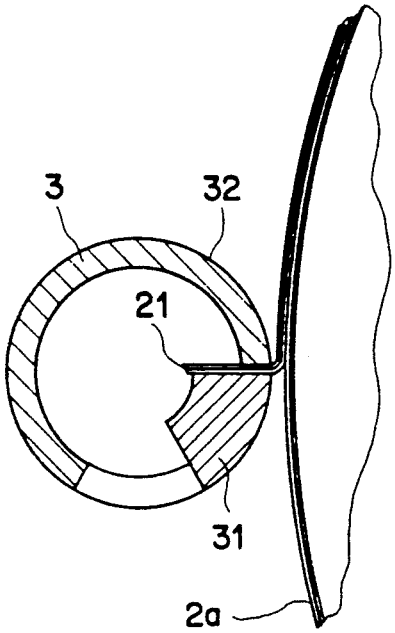
Figure 2D:
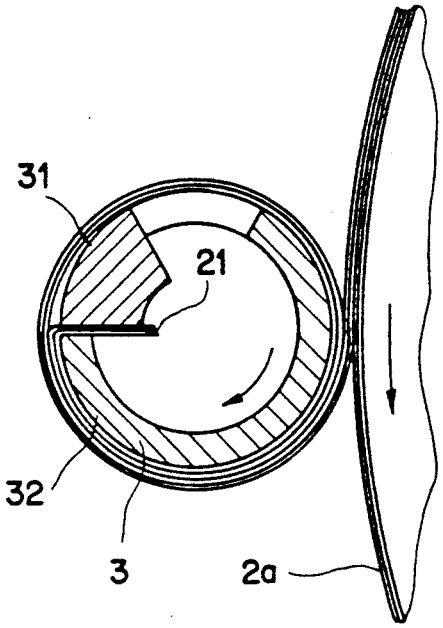
Figure 3A:
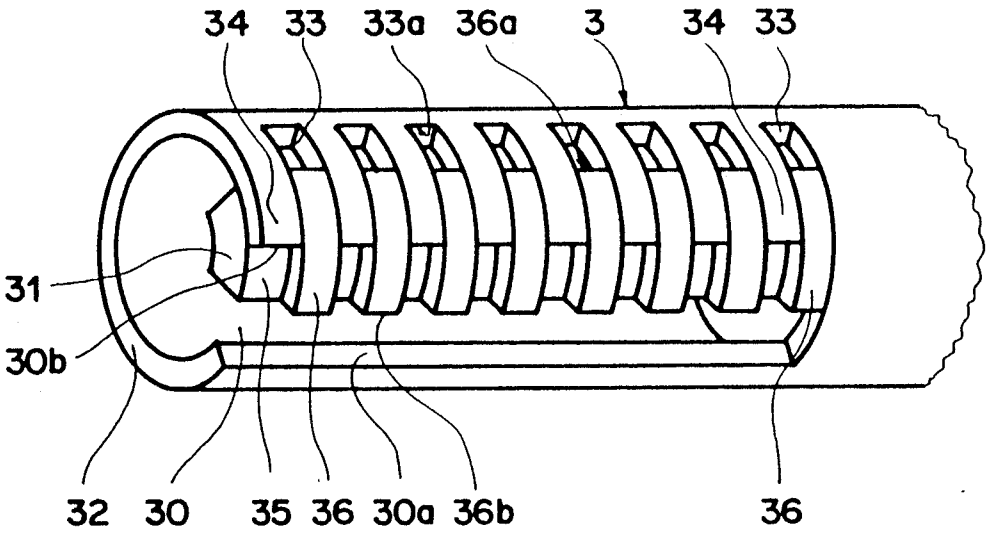
Figure 3B:
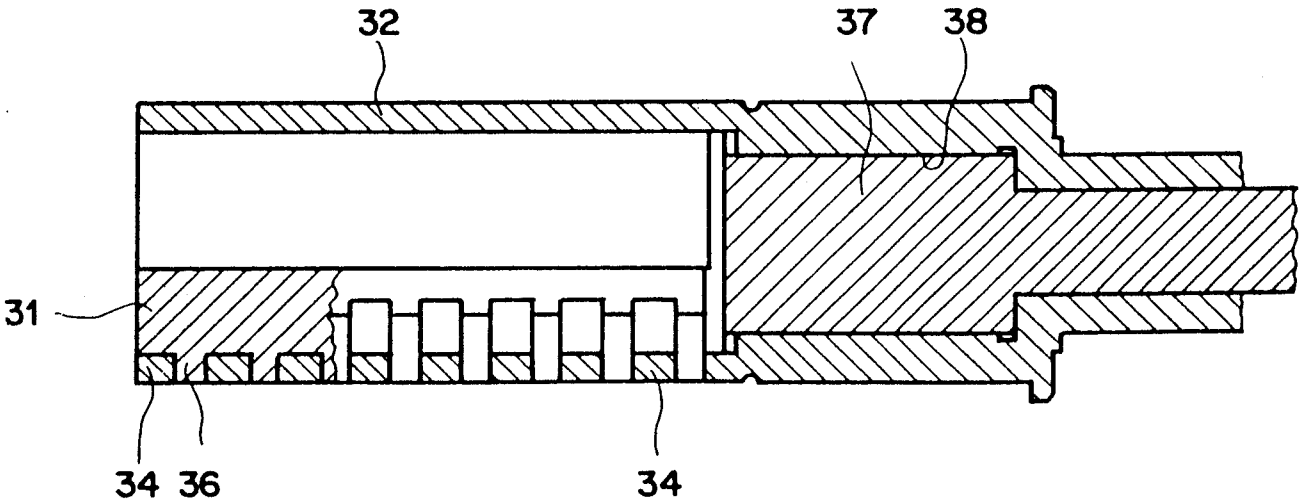
Figure 4A:
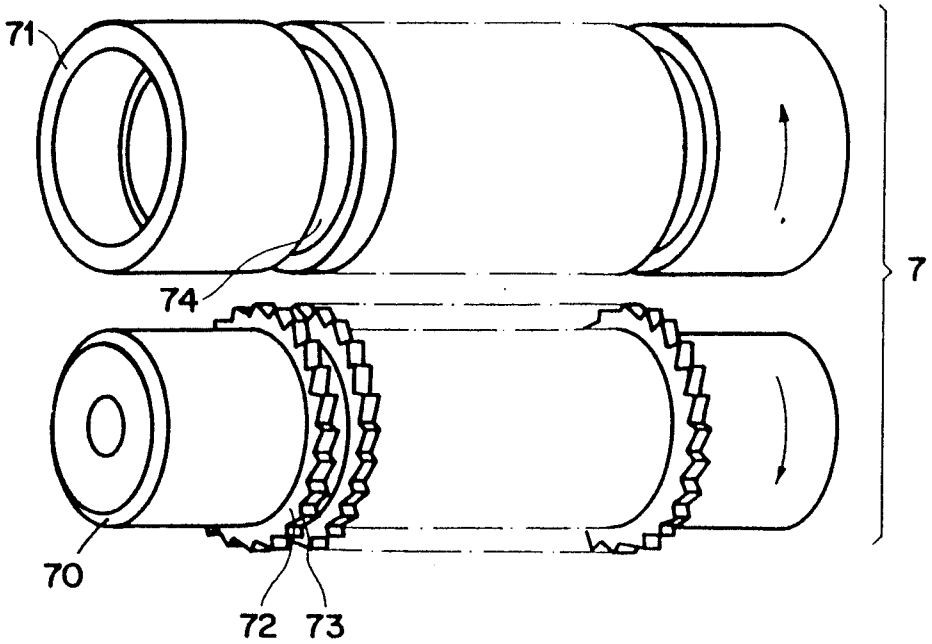
Figure 4B:
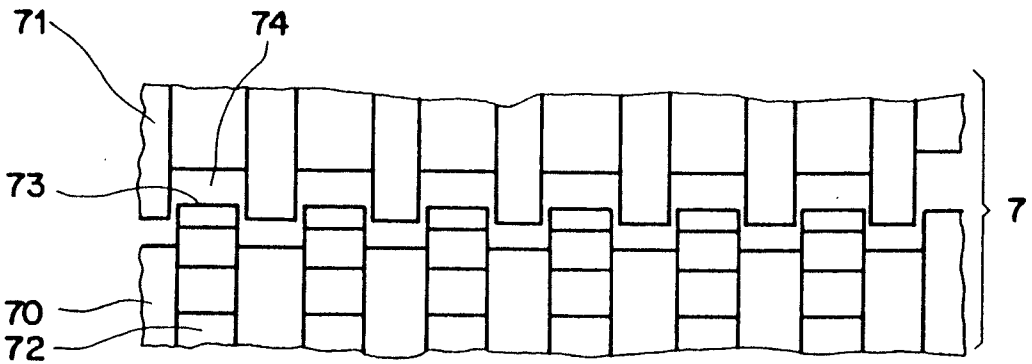
Figure 5B:
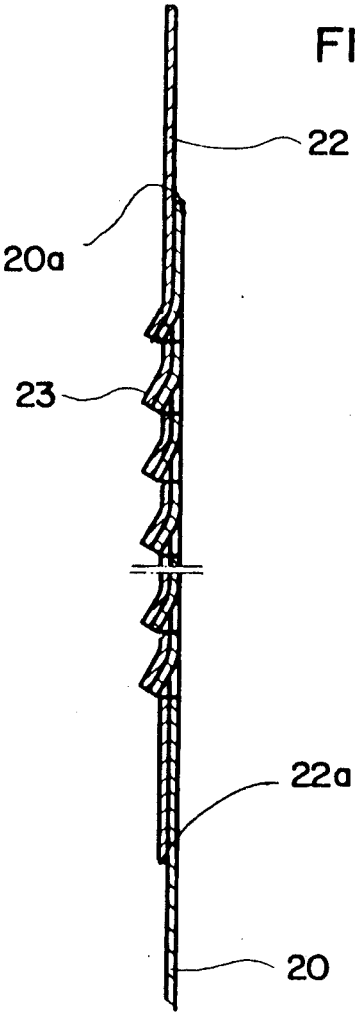
Figure 5A:
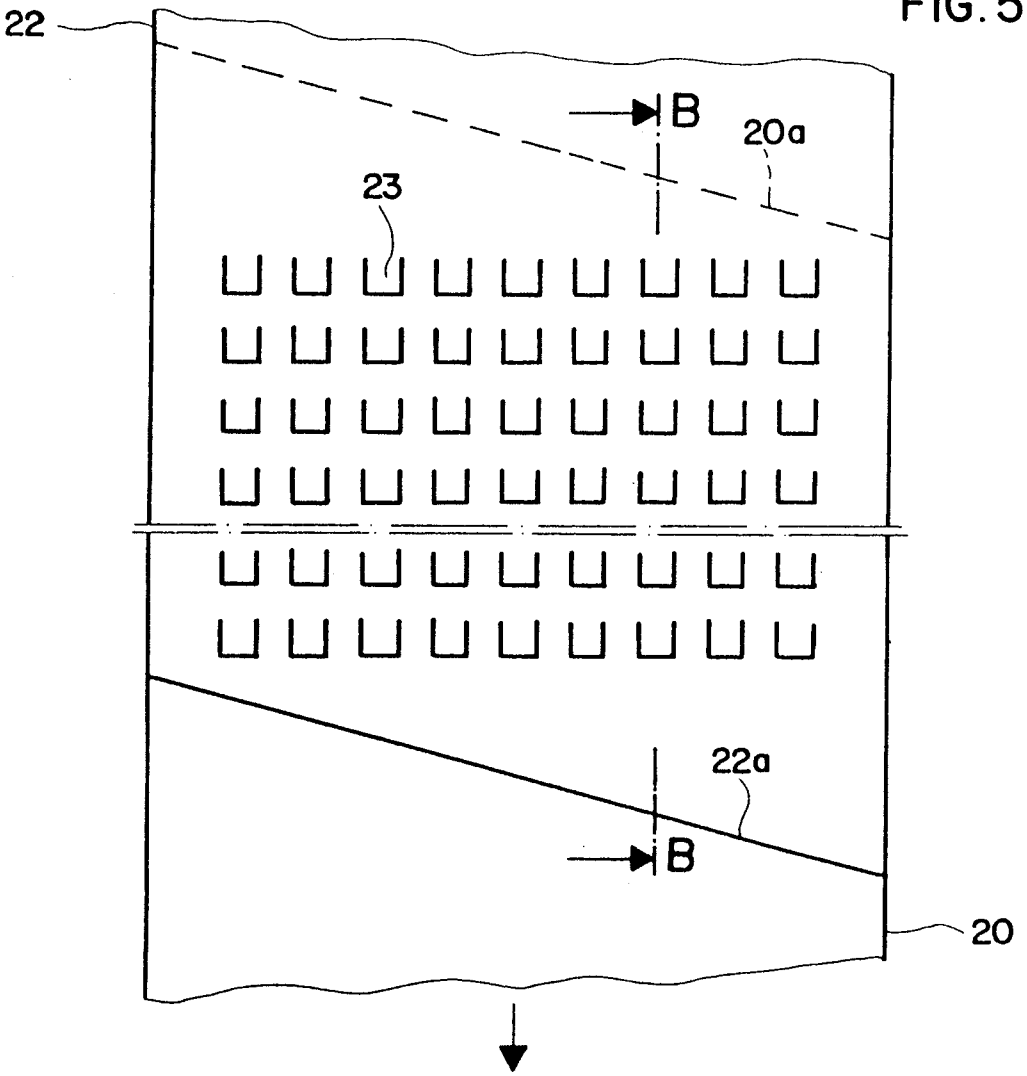

Preferred embodiments of the invention will now be described in detail with reference to the accompanying drawings, in which:

FIG. 1 is a diagrammatic elevation of a machine equipped with the apparatus according to the invention, FIGS. 2A-2D are details of FIG. 1, partially in section, illustrating several operating steps of a cylindrical seizing element, FIGS. 3A and 3B are a partial perspective view and longitudinal section, respectively, of a cylindrical seizing element, FIG. 4A is a perspective view of a pair of pressing rollers, FIG. 4B is a partial diagrammatic plan view on a larger scale of the pressing rollers of FIG. 4A, showing their interpenetration, FIG. 5A is a top plan view of two webs of paper spliced by perforation, and FIG. 5B is a section taken on the line B—B of FIG. 5A.

In FIG. 1, a machine paying out a strip of paper is indicated diagrammatically by its frame 1. It includes particularly a robot arm 10 having a head 11 capable of effecting the movements of reels 2, 2*a*, and 2*b*, as well as those of a roller support 14, to be described below. Robot arm 10 and head 11 do not form part of the invention and may be of any type known in the art, only some of the operations carried out by arm 10 being novel.

A reel of paper 2, driven rotatingly by a first rotating shaft, 12, pays out its strip of paper 20 toward a machine (not shown) responsible for disposing it about either a rod of tobacco or a cigarette filter. A second reel 2*a* has been taken by arm 10 from a storage position, where a third reel 2*b* is waiting, and fixed to a second rotating shaft 13. Reels 2*a* and 2*b* are full, and their outermost turns are possibly covered by a protective strip of heavy paper. When reel 2 is virtually empty, i.e., when its outside diameter has reached a predetermined value, the process of opening the fresh reel 2*a* is activated, first of all by causing robot arm 10 to move roller support 14 close to reel 2*a* so that a seizing cylinder 3 comes tangentially in contact with the outside circumference of reel 2*a*.

The details of the following steps of the process of opening fresh reel 2*a* are shown in FIGS. 2A-2D. In FIG. 2A, seizing cylinder 3 has been brought in contact with fresh reel 2*a* and has been pivoted so that when it is open, as shown in the drawing, it is ready to receive the lengths of outer turns. The mechanism for opening and closing seizing cylinder 3 will be explained in more detail below. A first cutting device 4, fixed to support 14 and comprising a cutting blade 40, is pushed by a piston device 41 against fresh reel 2*a* so that blade 40 cuts any protective strip of heavy paper which may encircle the reel, as well as a few of the outer turns of reel 2*a*, by a transverse movement of blade 40. When this operation is terminated, cutting device 4 is moved away from reel 2*a*.

The following step of the process is seen in FIG. 2B, where a blower device 5 has been moved directly next to the cut just made. Blower device 5 is fed by a source of compressed air (not shown) and comprises in particular a plurality of nozzles 50, 51, 52, graduatedly oriented and actuated in succession. Thus the first nozzle 50, which is directed toward the cut made on reel 2*a*, is actuated first and lifts the cut ends 21; the second nozzle 51, blowing in a direction farther back than the first one, detaches cut ends 21 and starts to curve them toward an aperture 30 of seizing cylinder 3; and the third nozzle 52, directed even farther back that the previous one, is then actuated in order to introduce cut ends 21 into aperture 30. Although blower device 5 has been described as having three nozzles 50, 51, and 52, it will be obvious that it might comprise a different number of nozzles, or even have only a single nozzle, in which case it would pivot through a certain angle about its axis in order to lift, detach, curve, and place cut turns 21 within aperture 30 of seizing cylinder 3. Seizing cylinder 3 is then closed again, as shown in FIG. 2C, a movable part 31 of cylinder 3 gripping cut ends 21 against a fixed part 32 thereof.

In FIG. 2D, seizing cylinder 3 has been set rotating, drawing along cut turns 21 and, consequently, fresh reel 2*a*. This rotation lasts long enough to wind all the cut outer turns about seizing cylinder 3, as well as a certain length of the paper strip coming from reel 2*a*.

Details of the design and operation of cylindrical seizing element 3 may be seen in FIGS. 3A, a perspective view of the active portion of the seizing cylinder in half-open or half-closed position, and 3B, a partial sectional view of element 3. As stated above, seizing cylinder 3 is made up of two main parts: movable part 31 and fixed part 32. The active portion of fixed part 32 is a tubular element in which aperture 30, corresponding to a 60° sector removed from the tubular element, has been contrived, defining two faces 30*a* and 30*b*. Also along a 60° sector of the tubular element, a number of notches 33 have been cut in face 30*b*, disposed side by side along the longitudinal axis of seizing cylinder 3 and separated by teeth 34. Thus, fixed part 32 has the appearance of a sort of cylindrical comb made up of teeth 34 separated by notches 33. Movable part 31 is a 60° cylindrical sector portion 35, the outside diameter of which matches the inside diameter of fixed part 32; portion 35 is topped by a number of teeth 36, each corresponding in size and location to a notch 33 of fixed part 32.

Cylindrical sector portion 35 of movable part 31 continues into a cylindrical shaft 37 pivoting within a cylindrical cavity 38 forming an extension of the active portion of fixed part 32. Thus, causing cylindrical shaft 37 to rotate in one direction or the other causes movable part 31, fixed to it, to pivot; consequently teeth 36 of movable part 31 are moved into notches 33 of fixed part 32. This movement takes place between two end positions, the first being the open position, where the ends 36*a* of teeth 36 butt against the backs 33*a* of notches 33, the ends 36*b* of teeth 36 then being aligned on the face 30*b* corresponding to the ends of teeth 34 of fixed part 32, which defines aperture 30 of seizing cylinder 3;

while the second end position is when teeth 36 have pivoted in notches 33 until the ends 36*d* of these teeth are in contact with surface 30*a* of fixed part 32, i.e., when they have gripped cut turns 21 between ends 36*b* and surface 30*a*. In this way, seizing cylinder 3 can open and close through the pivoting movement of movable part 31 relative to fixed part 32.

The outside surface of seizing cylinder 3 remains substantially cylindrical except for aperture 30, when open, as well as notches 33 and the gaps between teeth 36 of movable part 31; the outside diameter of the cylindrical surface remains constant for each position of movable part 31 relative to fixed part 32. As mentioned above, when seizing cylinder 3 is in closed position, gripping cut turns 21, it is set rotating about its longitudinal axis, movable part 31 remaining closed relative to fixed part 32. Both the means used for actuating movable part 31 relative to fixed part 32 and those for rotating seizing cylinder 3 as a whole are conventional and are therefore not shown. FIGS. 3A and 3B illustrate a seizing cylinder 3 in which fixed part 32 and movable part 31 each comprise eight teeth. It will be obvious, however, that the cylinder forming part of the invention may comprise any number of teeth, this number being determined principally by the width of the strip of paper to be seized. By the same token, although the opening and closing angle of the cylinder has been described here as 60°, any other angle yielding an adequate aperture 30 of seizing cylinder 3 may be adopted.

Reverting to FIG. 1, head 11 of robot arm 10 seizes support 14 and brings it into the lower position, indicated in dot-dash lines. When this is done, seizing cylinder 3 carries along with it the first turn of the strip of paper 22 coming from reel 2*a* and disposes it parallel and close to the strip of paper 20 still unwinding from virtually empty reel 2. The speeds of rotation of cylinder 3 and reel 2*a* are adjusted so that strip 22 remains taut and is paid out at the same speed as strip 20 unwinding from reel 2. A pneumatic device, symbolized by block 6, then, in succession, actuates a second cutting device 60, cutting strip 20 unwinding from virtually empty reel 2, slightly upstream from the location where strips 20 and 22 are to be joined; moves the two pressing rollers 70 and 71 together so that they can splice strips 20 and 22; moves rollers 70 and 71 apart again once a certain length of strips 20 and 22 has been spliced; and finally, actuates a third cutting device 61 in order to cut the end of strip 22 still attached to seizing cylinder 3. The end of strip 20 is now joined to the end of strip 22, so that it is reel 2*a* which is feeding paper to the machine situated downstream for disposing that strip of paper about a rod of tobacco or a cigarette filter. The sequence of operations described above, controlled by pneumatic device 6, takes place in a very brief lapse of time so that the length of paper where strips 20 and 22 are superimposed is as short as possible.

At the end of the cycle, robot arm 10 returns support 14 to the upper position, and seizing cylinder 3 reopens, releasing the free ends 21 and permitting a conventional disposal device (not shown) to remove the layers of paper wound around seizing cylinder 3. Next, robot arm 10 seizes the rest of reel 2 and removes it. When reel 2*a* has paid out a certain length of the strip of paper and has thus reached a given diameter, robot arm 10 transfers it to the first rotating shaft 12, where it continues to unwind until it is virtually empty, and a new cycle of operations is triggered.

FIGS. 4A and 4B show details of the design of pressing-roller device 7. FIG. 4A is a perspective view of rollers 70 and 71, disposed face to face, while FIG. 4B is a diagrammatic view on a larger scale showing the interpenetration of rollers 70 and 71. The first pressing roller 70 is composed of a cylinder on which a plurality of cylindrical rings 72 are disposed side by side and spaced from one another. Each of the rings 72 bears a plurality of substantially triangular teeth 73. The two accessible sides of the triangle formed by each tooth 73 are not equal, each tooth presenting, during rotation of roller 70, first the longer of the two sides, then the shorter one along a more abrupt slope. Facing roller 70 is the second pressing roller 71, likewise composed of a cylinder, but one in which a plurality of grooves 74 are made side by side, each of these grooves being situated opposite a ring 72 bearing teeth 73 of the first pressing roller 70. Thus, when the two strips of paper 20 and 22 are pressed between the two rollers 70 and 71, the strips are spliced in that the asymmetrical triangular shape of teeth 73 and their interpenetration in grooves 74 causes the two strips of paper to tear opposite each tooth 73, thus constituting a splice as will be described below.

FIGS. 5A and 5B are two views of the splice of the two strips 20 and 22. FIG. 5A is a plan view of the splice, strip 22 cut at its end 22*a* being superimposed upon strip 20 cut at its end 20*a*. The two strip ends 20*a* and 22*a* are slanted inasmuch as the cut was made while strips 20 and 22 were moving. The middle part of the superimposed portion is made up of a plurality of tabs 23 aligned in a number of columns equal to the number of rings 72 bearing triangular teeth 73 of roller 70, and in a number of rows which is a function of the time during which roller 70 and roller 71 are pressed against one another.

FIG. 5B, a section taken on the line B—B of FIG. 5A, shows clearly that the two strips of paper 20 and 22 have been perforated and that each tab 23 is made up of two bent tongues of paper. This type of splice according to the present invention differs essentially from the prior art, where the two strips are simply superimposed and crimped without being perforated; it is possible owing to the particular inventive structure of the two pressing rollers 70 and 71, as well as of the teeth 73. It will be noted from FIG. 5B that longitudinal traction of one strip over the other cannot separate them but, on the contrary, causes them to interpenetrate even more.

FIG. 5A shows the tabs 23 aligned in a number of straight lines, resulting from the fact that the teeth 73 on each ring 72 are aligned with one another. It is quite possible, however, to offset the teeth from one ring to another so as to obtain a staggered arrangement of tabs 23, for example.

Thus, by means of the method and apparatus according to the present invention, it is possible, on a single machine, to present a fresh reel, to open it, to take off the strip of closure paper and a few outer turns of the fresh reel, to join the leading end of the web of paper coming from the fresh reel to the trailing end of an expiring reel, and to remove the latter reel, all without interrupting the feed of paper to the machine situated downstream. The method and apparatus according to the present invention, and particularly the pressing-roller device, have been specially developed for splicing two webs of paper intended to encircle cigarette filters. In view of the characteristics and the strength of the splice where the two webs of paper are caused to interpenetrate to the point of perforation, this type of splice may also be used for joining other types of strips, whether webs of paper of some other composition or even strips composed of thin sheets of aluminum, regardless of their width.

What is claimed is:

1. A method of opening a fresh reel of a web of paper wound in successive turns thereon and of connecting the leading end of the web to the trailing end of a web of paper wound on an expiring reel rotating on a first rotating shaft, comprising the steps of:

actuating a first cutting device in order to cut a plurality of outer turns of the fresh reel along a line parallel to the axis of a second rotating shaft, opening a gripping aperture of a cylindrical seizing element for receiving one end of the cut outer turns, bringing the cylindrical outside surface of the cylindrical seizing element, the axis of which is parallel to that of the first rotating shaft, into tangential contact with the cylindrical outside surface of the fresh reel and causing the end of the cut outer turns to enter the gripping aperture, closing the gripping aperture of the cylindrical seizing element in order to grip the end of the cut outer turns, rotating the seizing element in order to wind up the cut turns and a few of the outer turns of the fresh reel, thereby also rotating the fresh reel, traversing the rotating seizing element in order to bring it close to the strip of paper of the expiring reel, in such a way that the strip of the fresh reel unwinds parallel to and at the same speed as the strip of the expiring reel, actuating a second cutting device to cut the portion of paper strip attached to the expiring reel, actuating a pressing-roller device in order to fix the web of paper coming from the fresh reel to the web of paper coming from the expiring reel, and actuating a third cutting device to cut the end of paper strip attached to the seizing device.

2. The method of claim 1 wherein the strips of paper are for encircling cigarette filters.

3. Apparatus for opening a fresh reel of a web of paper wound in successive turns thereon and of connecting the leading end of the web to the trailing end of a web of paper wound on an expiring reel, of the type having a first rotating shaft for supporting an expiring reel, a second rotating shaft disposed parallel to said first rotating shaft for supporting a fresh reel, a first cutting device capable of severing a plurality of outer turns of paper wound on the fresh reel along a line parallel to said second rotating shaft, and robot arm means for placing a fresh reel on said second rotating shaft and withdrawing the expiring reel from said first rotating shaft, wherein the improvement comprises:

a cylindrical seizing element including a gripping portion therein, a blower device having inclined nozzles, co-operating with said seizing element for separating from the fresh reel and introducing into said seizing element the severed outer turns of the fresh reel, robot arm means for moving said seizing element close to the strip of paper on the expiring reel and of withdrawing the fresh reel from said second rotating shaft to place it on said first rotating shaft, a second cutting device for cutting the portion of strip attached to the expiring reel, a pressing-roller device for splicing the web of paper coming from the fresh reel to the web of paper coming from the expiring reel, a third cutting device capable of cutting the portion of strip attached to said seizing element upstream from the splice, means for withdrawing the severed turns of paper wound around said seizing element.

4. The apparatus of claim 3, wherein said gripping portion includes a cylindrical segment having an outside diameter identical to that of said seizing element, said gripping portion being pivotable about the longitudinal axis of said seizing element for opening and closing a cylindrical sector-shaped aperture, said apparatus further comprising means for rotating said seizing element about its longitudinal axis.

5. The apparatus of claim 4, wherein said cylindrical seizing element further includes means for withdrawing turns of paper wound about said element when said aperture is open.

6. The apparatus of claim 3, wherein said blower device includes a plurality of said nozzles inclined at differing angles and means for actuating said nozzles in succession.

7. The apparatus of claim 3, wherein said pressing-roller device comprises a first cylindrical roller having a plurality of regularly spaced, parallel cylindrical grooves, and a second cylindrical roller having a plurality of regularly spaced, parallel cylindrical rings, each of said rings being disposed opposite one of said grooves and bearing a plurality of triangular teeth disposed at regular intervals along the circumference thereof.

* * * * *